United States Patent [19]

Funes, Jr.

[11] Patent Number: 5,010,654

[45] Date of Patent: Apr. 30, 1991

[54] TILE SPACER

[75] Inventor: Horacio C. Funes, Jr., Dunellen, N.J.

[73] Assignee: Masonry Design Plus, Inc., Dunellen, N.J.

[21] Appl. No.: 471,536

[22] Filed: Jan. 29, 1990

[51] Int. Cl.[5] ..... G01B 5/14

[52] U.S. Cl. ..... 33/526; 33/DIG. 20

[58] Field of Search ..... 33/526, 518, 567, DIG. 20, 33/527, 562, 679.1, 48.3, 501.45

[56] References Cited

U.S. PATENT DOCUMENTS

| | | | |
|---|---|---|---|
| 304,245 | 8/1984 | Thomas | 33/483 |
| 987,703 | 3/1911 | Curtin | 33/199 R X |
| 2,846,772 | 8/1958 | Strausser | 33/534 |
| 2,930,135 | 3/1960 | Rodtz | 33/DIG. 20 |
| 3,735,497 | 5/1973 | Boettcher | 33/520 |
| 4,793,068 | 12/1988 | Golkar | 33/526 |

OTHER PUBLICATIONS

Product Catalog of Grove Products.

*Primary Examiner*—Harry N. Haroian

*Attorney, Agent, or Firm*—Lerner, David, Littenberg, Krunholz & Mentlik

[57] ABSTRACT

A spacer for use in maintaining a uniform joint area during installation of wall tiles and the like is constructed from a general U-shaped figure having an intermediate cross web member to provide additional strength. The web member also protects the installed wall tiles during removal when using an extraction tool which engages the web member to provide leverage. The depending legs of the U-shaped figure have uniform thickness. A wedged-shaped extension is arranged extending from the figure and terminates in a tab of uniform thickness. The spacers may be stacked back to back to accommodate different joint area thicknesses and the wedge-shaped extension may be utilized in leveling irregular tiles where non-uniform joint areas are required.

14 Claims, 1 Drawing Sheet

TILE SPACER

BACKGROUND OF THE INVENTION

The present invention relates in general to a wall tile spacer, and more particularly, to such a tile spacer for use in leveling both regular and irregular wall tiles and the like.

In the installation of tiles, for example ceramic wall tiles, it is desirable that the tiles be level with each other to form a uniform pattern such as rows and columns. Otherwise, the esthetics of the tiled area will be greatly impaired by the lack of uniformity in the pattern. The levelness and pattern uniformity of the installed tiles is often achieved by adjusting the spacing between individual tiles when the tiles are being set in the adhesive used to secure same to the underlying substrate such as a wall. The spacing between the tiles, typically referred to as grout lines or joint area, is maintained uniform or adjusted to compensate for any differences in the size of adjacent tiles due to their irregularities which is often found in ceramic and marble type tiles.

In order to provide for proper tile spacing and to maintain same while the adhesive sets, there is frequently used removable tile spacers. For example, there is known rectangular spacers having a wedge shaped profile to provide a gradual taper. Other tile spacers known include the use of cylindrical pegs and X-shaped pieces. In the construction industry, there is used plastic shims for the alignment and leveling of a wide variety of architectural components, such as windows, doors and curtain walls. Shims, such as those available from Grove Products, Inc. of Leominster, Mass. come in a variety of sizes and shapes. For example, there is known U-shaped shim having gradually tapered wedge-shaped legs and those with legs of uniform thickness.

Despite the variety of shims and tile spacers available, these spacers suffer from a number of disadvantages which limit their usefulness in accommodating the installation of tiles where various tile spacings are required as, for example, when installing tiles of irregular dimension and when the joint area is greater than the single spacer dimension. For example, spacers of uniform thickness although being stackable for increased thickness, are limited to spacings in even multiples of their original thickness. The use of wedge shaped spacers, on the other hand, can only accommodate spacings up to a portion of their maximum thickness. Wedge-shaped spacers generally cannot be stacked to provide increased thickness if needed during tile installation. Thus, where non-uniform spacing is required, different types of uniform and wedge-shaped spacers must be separately purchased and combined in an attempt to provide the required spacing. As the uniform and wedge-shaped spacers are of different designs, it is difficult to combine them to adequately provide the range of spacings that may be required during tile installation.

Accordingly, it can be appreciated that there is an unsolved need for a universal spacer having both a uniform thickness portion and a wedge-shaped portion which may be stackable with one or more of such spaces to accommodate the desired spacing requirements during tile installation.

SUMMARY OF THE INVENTION

The tile spacer of the present invention is constructed from a flat body formed from a generally U-shaped member having a pair of laterally disposed legs. Each of the legs has a uniform thickness and reinforced by a central transverse cross web member. The web member provides protection to the installed tiles when using a spacer removal tool as will be explained hereinafter. A portion of the spacer extends outwardly from one of the legs in the form of a wedge-shaped extension having a tab end of uniform thickness. The single spacer can be used to accommodate uniform tile spacing by means of its legs or of irregular spacing by means of its wedge-shaped extension. In addition, multiple spacers of the present invention may be stacked, back to back, to utilize the uniform thickness of their legs and/or wedge-shaped extension to accommodate various thickness of the joint area.

In accordance with one embodiment of the present invention, there is provided a spacer constructed from a flat body formed from a pair of spaced apart surfaces, one end of the body having the pair of spaced apart surfaces arranged parallel to each other to provide a portion of uniform thickness therebetween, another end of the body having one of the spaced apart surfaces arranged at an angle to the other of the spaced apart surfaces to provide a portion of decreasing thickness therebetween.

In accordance with another embodiment of the present invention, there is provided a spacer constructed of a flat body formed from a pair of spaced apart surfaces, one end of the body including a pair of laterally spaced apart legs, each of the legs formed from the pair of spaced apart surfaces arranged parallel to each other to provide the legs with uniform thickness, a web member formed from the body connecting the spaced apart legs, and another end of the body having one of the spaced apart surfaces arranged at an angle to the other of the spaced apart surfaces to provide an extension having a wedge-shaped profile.

BRIEF DESCRIPTION OF THE DRAWINGS

The above description, as well as further objects, features and advantages of the present invention will be more fully understood with reference to the following detailed description of a tile spacer, when taken in conjunction with the accompanying drawings, wherein.

DETAILED DESCRIPTION

Figure 1:
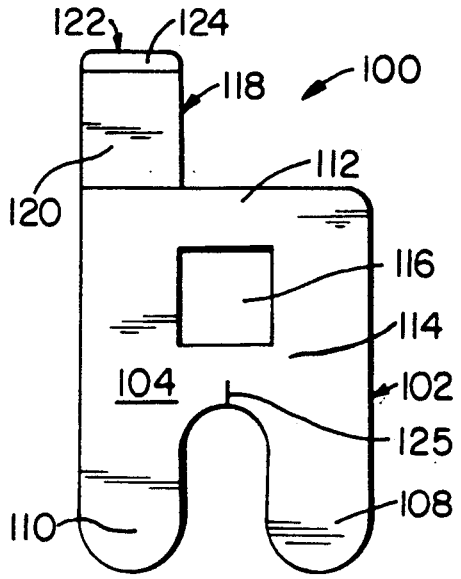
FIG. 1 is a plan view of the spacer constructed in accordance with the present invention.
Figure 2:
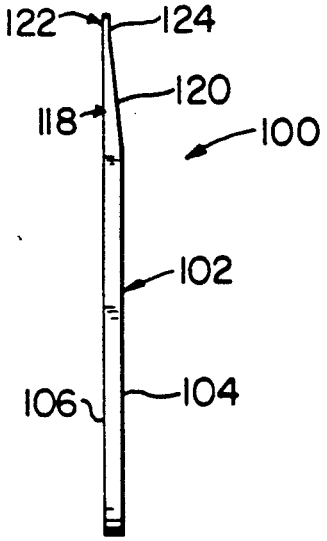
FIG. 2 is a side elevational view of the spacer constructed in accordance with the present invention.

Referring now to the drawings wherein like reference numerals represent like elements, there is shown in FIGS. 1 and 2 a spacer constructed in accordance with the present invention and designated generally by reference numeral 100. The spacer 100 is constructed from a flat body 102 having a front surface 104 and a rear surface 106 arranged parallel to one another. The body 102 includes a pair of laterally spaced apart legs 108,110 integrally connected across one common end by an upper web member 112 and centrally by an intermediate web member 114. An opening 116 is provided between the upper and intermediate web members 112,114. As a result of the parallel arrangement of the front and rear surfaces 104,106, the legs 108,110 have a uniform thickness, by way of example only, 0.0625 inches.

Integrally formed from the body 102 is a wedge-shaped extension 118 formed by a front sloping surface 120 opposing the rear surface 106. The wedge-shaped extension 118, at its minimum thickness, includes an extending tab 122 of uniform thickness formed between upper tab surface 124 and the rear surface 106 of the body 102. The wedge-shaped extension, by way of example only, has a maximum thickness of 0.0625 inches and extends to a minimum thickness of 0.020 inches, which corresponds to the uniform thickness of tab 122.

As shown in FIG. 1, the spacer 100 at its lower end has a U-shaped figure formed by the two depending spaced apart legs 108,110. The U-shaped figure is desirable so that when the user inserts the spacer 100 into the grout line or joint area, the user can see between the legs 108,110 to maintain visual contact with the line of the tiles being installed. The web member 114 also assists the user in gauging the depth as to how far the spacer 100 has been inserted into the joint area. Inserting the spacer 100 too far into the joint area can make it difficult for subsequent removal.

The intermediate web member 114 provides additional structural support for the spacer 100. In addition, the opening 116, in combination with the upper and intermediate web members 112,114, assists the user in extracting the spacer 100 from within the joint area after use. In this regard, the opening 116 may be engaged using a suitable extraction tool. The intermediate web member 114 supports the shaft of the extraction tool to provide leverage without touching the wall tiles to enable removal of the spacer 100. The intermediate web member 114 further prevents the spacer 100 from twisting or deforming during use. The spacer 100 may be subsequently stored using a wire looping device extending through the opening. A center guideline 125 may be provided to aid in centering the spacer 100 with the joint lines.

Figure 3:
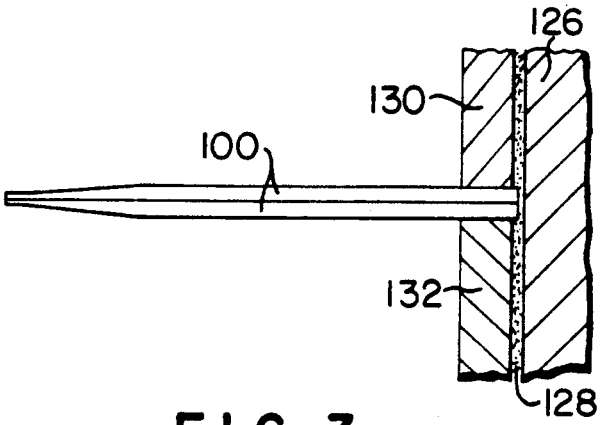
FIG. 3 is a side elevational view in partial cross-section showing the use of multiple spacers stacked back to back during the installation of wall tile in accordance with one embodiment of the present invention.

The use of the spacer 100 in a variety of tile installation applications of different joint thicknesses will now be described. Referring to FIG. 3, an upright supporting wall 126 is provided with a layer of adhesive 128. A pair of wall tiles 130,132 are set into the adhesive 128 in spaced apart relationship. As shown, a pair of spacers 100 are positioned back to back with legs 108,110 snugly positioned between the tiles 130,132 in the joint area to provide a uniform space, e.g., 0.125 inches. If desired, any number of spacers 100 may be stacked back to back to accommodate a joint area of a different dimension. Once the adhesive 126 has set, the spacers 100 may be removed from within the joint area using a suitable extraction tool and the like which engages the opening 116 and/or intermediate web member 114. The spacer 100 may also be removed by hand. By being constructed from suitable plastic material, the spacer 100 will withstand extreme pressures and can be easily removed after the adhesive has set the tiles. The spacers 100 may be stored for use during another installation.

Figure 4:
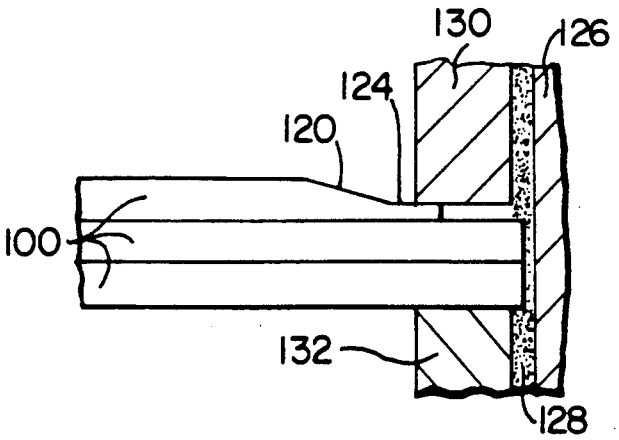
FIG. 4 is a side elevational view in partial cross-section showing the use of multiple spacers stacked back to back during the installation of wall tile in accordance with another embodiment of the present invention.

Referring now to FIG. 4, three spacers 100 are shown stacked back to back for maintaining the dimension of the joint area formed between tiles 130,132. In this regard, it is noted that the upper spacer 100 is arranged such that the web-shaped extension 118 overlies one of the leg members 108,110. As illustrated, only the tab 122 extends within the joint area to maintain a uniform spacing of less than the full thickness of three spacers 100, i.e., 0.145 inches. If desired, a fourth spacer 100 may be arranged back to back with the lower most spacer and having its tab 122 extending within the joint area to provide uniform spacing of 0.165 inches.

Figure 5:
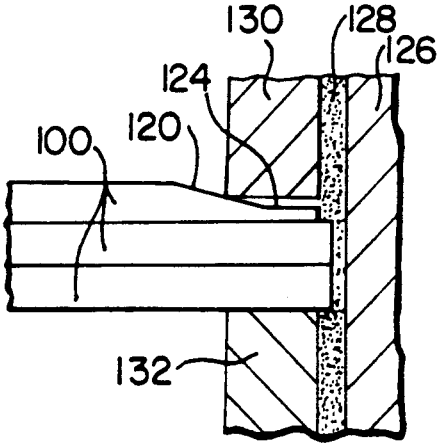
FIG. 5 is a side elevational view in partial cross-section showing the use of multiple spacers stacked back to back during the installation of wall tile in accordance with another embodiment of the present invention.

Referring now to FIG. 5, the use of a plurality of spacers 100 in accordance with another installation of tiles 130,132 which are irregular and require a more variable joint area spacing control will now be described. A pair of spacers 100 are arranged back to back in the manner as shown in FIG. 3. A third spacer 100 is arranged back to back overlying the top most spacer as shown in FIG. 4. However, the upper most spacer 100 is pushed into the joint area until tile 130 rides upon the front sloping surface 120 of the wedge-shaped extension 118. The user to obtain the proper joint area spacing may slide the upper spacer 100 further into the joint area while the lower two spacers remain in alignment. As such, the upper spacer 100 can provide for adjustment of the joint area spacing from between 0.020 inches and 0.0625 inches.

As thus far described, the spacer 100 of the present invention eliminates the need for all other kinds of spacing devices that have heretofore been known. The use of a plurality of spacers 100, stacked back to back, can accommodate joint areas over a wide ranges of thicknesses when installing uniform and irregular tiles and the like. As the spacer 100 is integrally formed from plastic material, such as high impact styrene, it should be understood that other thicknesses than those described may be utilized in accordance with the spacer of the present invention.

Although the invention herein has been described with references to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A spacer comprising a flat body formed from a pair of spaced apart surfaces, one end of said body having said pair of spaced apart surfaces arranged parallel to each other to provide a portion of uniform thickness therebetween, said one end of said body including a pair of laterally spaced apart legs each of the same uniform thickness formed by said spaced apart surfaces, a first web formed from said body connecting said legs at one common end thereof, a second web formed from said body connecting said legs at a location spaced from said first web to provide an opening therebetween, and another end of said body having a surface arranged at an angle to one of said spaced apart surfaces to provide a portion of decreasing thickness therebetween.

2. The spacer of claim 1, wherein said body is constructed from plastic material.

3. The spacer of claim 1, wherein said another end of said body having decreasing thicknesses is arranged in alignment with one of said legs.

4. The spacer of claim 1, wherein said another end of said body comprises a wedge-shaped extension having said decreasing thickness.

5. The spacer of claim 4, wherein the maximum thickness of said wedge-shaped extension corresponds to the thickness of said portion of uniform thickness.

6. The spacer of claim 1, wherein said another end of said body having a portion of decreasing thickness includes a tab of uniform thickness corresponding to the minimum thickness of said portion of decreasing thickness.

7. A spacer comprising a flat body formed from a pair of spaced apart surfaces, one end of said body including a pair of laterally spaced apart legs, each of said legs formed from said pair of spaced apart surfaces arranged parallel to each other to provide said legs with uniform thickness, a web member formed from said body connecting said spaced apart legs at one common end thereof to form a U-shaped member, and another end of said body extending outwardly from said U-shaped member having a surface arranged at an angle to one of said spaced apart surfaces to provide an extension having a wedge-shaped profile.

8. The spacer of claim 7, wherein said body is constructed of plastic material.

9. The spacer of claim 7, wherein said body includes an opening between said legs and said extension to enable engagement of said body.

10. The spacer of claim 7, wherein said extension is arrangement in alignment with one of said legs.

11. The spacer of claim 7, wherein the maximum thickness of said extension corresponds to the thickness of said legs.

12. The spacer of claim 7, further including a tab of uniform thickness extending from said extension.

13. The spacer of claim 7, further including a guideline provided on said web member between said spaced apart legs.

14. A spacer comprising a flat body formed from a pair of spaced apart surfaces, one end of said body having said pair of spaced apart surfaces arranged parallel to each other to provide a portion of uniform thickness therebetween, said one end of said body including a pair of laterally spaced apart legs each of the same uniform thickness formed by said spaced apart surfaces, a first web formed from said body connecting said legs at one common end thereof to form a U-shaped member, a second web formed from said body connecting said legs at a location spaced from said first web to provide an opening therebetween, and another end of said body adjacent said first web extending outwardly from said U-shaped member having a surface arranged at an angle to one of said spaced apart surfaces to provide a portion of decreasing thickness therebetween, said another end of said body having a portion of decreasing thickness including a tab of uniform thickness corresponding to the minimum thickness of said portion of decreasing thickness.

* * * * *